US012287102B2

(12) United States Patent
Watanabe

(10) Patent No.: US 12,287,102 B2
(45) Date of Patent: Apr. 29, 2025

(54) OUTDOOR UNIT FOR AIR-CONDITIONING APPARATUS, AND AIR-CONDITIONING APPARATUS

(71) Applicant: Mitsubishi Electric Corporation, Tokyo (JP)

(72) Inventor: Masayuki Watanabe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 836 days.

(21) Appl. No.: 17/419,627

(22) PCT Filed: Mar. 1, 2019

(86) PCT No.: PCT/JP2019/008121

§ 371 (c)(1),
(2) Date: Jun. 29, 2021

(87) PCT Pub. No.: WO2020/178906

PCT Pub. Date: Sep. 10, 2020

(65) Prior Publication Data

US 2022/0082271 A1 Mar. 17, 2022

(51) Int. Cl.
*F24F 1/12* (2011.01)
*F24F 11/88* (2018.01)
(Continued)

(52) U.S. Cl.
CPC ..... *F24F 1/12* (2013.01); *F24F 11/88* (2018.01); *F24F 1/24* (2013.01); *F24F 13/24* (2013.01);
(Continued)

(58) Field of Classification Search
CPC ..... F24F 1/12; F24F 1/40; F24F 11/88; F24F 13/24; F24F 2013/242; F25B 2500/12; F25B 2500/13; F04B 39/0027
See application file for complete search history.

(56) References Cited

U.S. PATENT DOCUMENTS

2012/0194041 A1* 8/2012 Hika ..... F24F 1/46 312/100

FOREIGN PATENT DOCUMENTS

CN 1410717 A 4/2003
CN 204574296 U 8/2015
(Continued)

OTHER PUBLICATIONS

International Search Report of the International Searching Authority mailed May 14, 2019 for the corresponding International application No. PCT/JP2019/008121 (and English translation).
(Continued)

*Primary Examiner* — John F Pettitt, III
*Assistant Examiner* — Webeshet Mengesha
(74) *Attorney, Agent, or Firm* — Posz Law Group, PLC

(57) ABSTRACT

An outdoor unit for an air-conditioning apparatus includes a machine chamber, a compressor provided in and at a bottom of the machine chamber, a reactor provided in the machine chamber and higher than the compressor and configured to rectify an electric current to be supplied to the compressor, a peripheral soundproof material that extends as high as a position of the reactor and encloses the compressor, and an upper soundproof material that covers at least part of the reactor and is placed on the peripheral soundproof material.

6 Claims, 10 Drawing Sheets

(51) Int. Cl.
*F24F 1/24* (2011.01)
*F24F 13/24* (2006.01)

(52) U.S. Cl.
CPC ..... *F24F 2013/242* (2013.01); *F25B 2500/12* (2013.01); *F25B 2500/13* (2013.01)

(56) References Cited

FOREIGN PATENT DOCUMENTS

| | | | | | |
|---|---|---|---|---|---|
| EP | 2 949 934 | A2 | | 12/2015 | |
| JP | H03-125831 | A | | 5/1991 | |
| JP | 2002-013764 | A | | 1/2002 | |
| JP | 2003106570 | A | * | 4/2003 | ..... F24F 1/12 |
| JP | 2005-113695 | A | | 4/2005 | |
| JP | 2014118905 | A | * | 6/2014 | |
| JP | 2014119148 | A | * | 6/2014 | |
| JP | 2015-187507 | A | | 10/2015 | |

OTHER PUBLICATIONS

Office Action dated May 6, 2022 issued in corresponding CN patent application No. 201980093225.7 (and Machine Translation).
Office Action dated Jun. 30, 2022 issued in corresponding DE Patent Application No. 112019006948.9 (and English translation).

* cited by examiner

OUTDOOR UNIT FOR AIR-CONDITIONING APPARATUS, AND AIR-CONDITIONING APPARATUS

CROSS REFERENCE TO RELATED APPLICATION

This application is a U.S. national stage application of International Application No. PCT/JP2019/008121, filed on Mar. 1, 2019, the contents of which are incorporated herein by reference.

TECHNICAL FIELD

The present disclosure relates to an outdoor unit intended for an air-conditioning apparatus and including a compressor and a reactor, and to an air-conditioning apparatus.

BACKGROUND

In Patent Literature 1, an outdoor unit for an air-conditioning apparatus is disclosed in which an electrical substrate is enclosed by a box made of sheet metal, to block out heat radiated from a reactor. As a machine chamber of the outdoor unit is closed by the box, an electromagnetic sound emitted from the reactor is blocked out.

PATENT LITERATURE

Patent Literature 1: Japanese Unexamined Patent Application Publication No. 2003-106570

In the technique disclosed by Patent Literature 1, however, a space in the machine chamber that is below the electrical substrate is completely closed by the box. Such a situation causes a problem in that a space in the machine chamber is narrowed and limited. Moreover, the use of the box requires an increased amount of sheet metal, leading to another problem of cost increase.

SUMMARY

The present disclosure is to solve the above problems and provides an outdoor unit intended for an air-conditioning apparatus, and an air-conditioning apparatus in each of which an electromagnetic sound of a reactor and an operating sound of a compressor are both reduced, the space in a machine chamber is not limited to be narrow, and a cost reduction is achieved.

An outdoor unit for an air-conditioning apparatus according to an embodiment of the present disclosure includes a machine chamber, a compressor provided in and at a bottom of the machine chamber, a reactor provided in the machine chamber and higher than the compressor and configured to rectify an electric current to be supplied to the compressor, a peripheral soundproof material that extends as high as a position of the reactor and encloses the compressor, and an upper soundproof material that covers at least part of the reactor and is placed on the peripheral soundproof material.

An air-conditioning apparatus according to another embodiment of the present disclosure includes the above outdoor unit for an air-conditioning apparatus.

The outdoor unit for an air-conditioning apparatus and the air-conditioning apparatus according to an embodiment of the present disclosure each include the upper soundproof material that covers at least part of the reactor and is placed on the peripheral soundproof material. Therefore, the electromagnetic sound of the reactor and the operating sound of the compressor are both reduced, the space in the machine chamber is not limited to be narrow, and a cost reduction is achieved.

DETAILED DESCRIPTION

Figure 1:
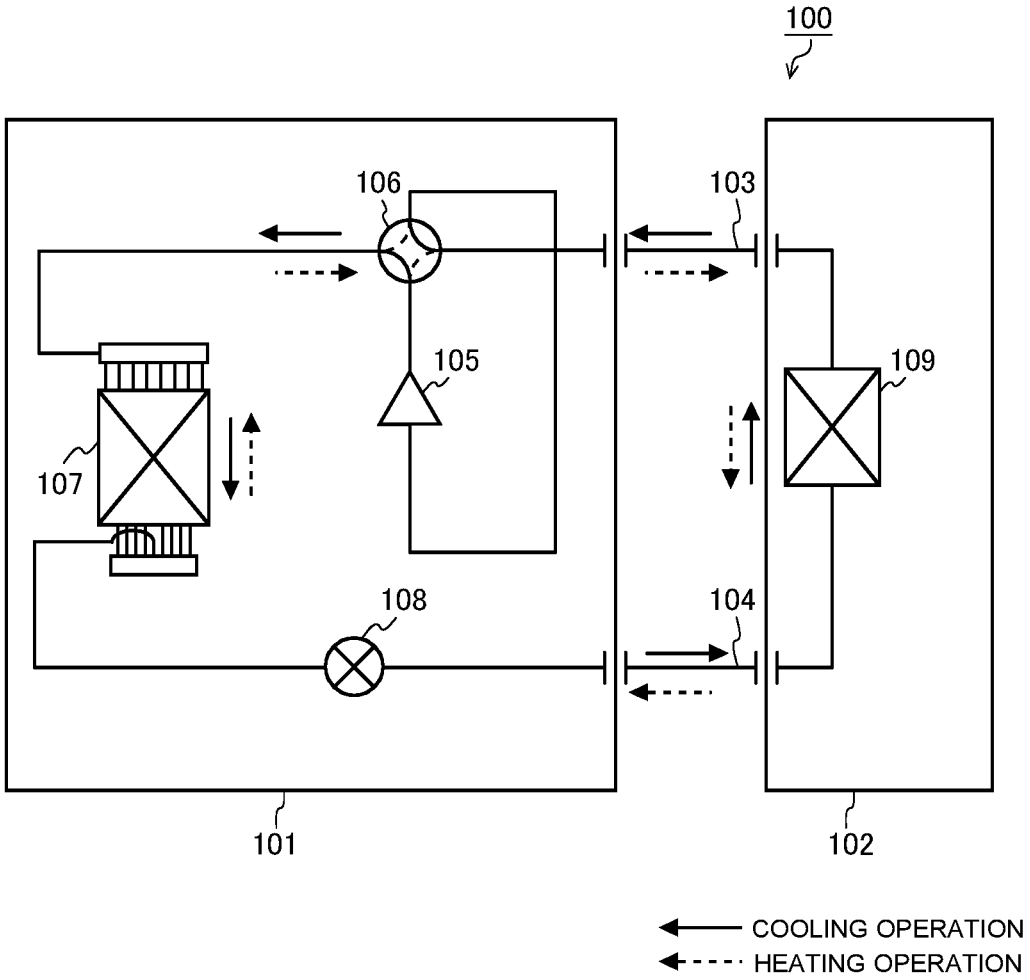
FIG. 1 is a refrigerant circuit diagram illustrating an air-conditioning apparatus according to Embodiment 1 of the present disclosure.

Embodiments of the present disclosure will be described below with reference to the drawings. In the drawings, the same reference signs denote the same or equivalent elements, which applies to the entirety of this specification. In sectional views, some of the elements are not hatched, considering visibility. The forms of the elements described in the entirety of this specification are only exemplary and are not limited to the described forms.

Embodiment 1

<Configuration of Air-Conditioning Apparatus 100>

FIG. 1 is a refrigerant circuit diagram illustrating an air-conditioning apparatus 100 according to Embodiment 1 of the present disclosure. The air-conditioning apparatus 100 illustrated in FIG. 1 includes an outdoor unit 101 and an indoor unit 102. The outdoor unit 101 and the indoor unit 102 are connected to each other by a gas refrigerant pipe 103 and a liquid refrigerant pipe 104.

The outdoor unit 101 includes a compressor 105, a four-way valve 106, an outdoor heat exchanger 107, and an expansion valve 108.

The compressor 105 compresses refrigerant suctioned into the compressor 105 and discharges the refrigerant. The operating frequency of the compressor 105 may be changed arbitrarily by using a device such as an inverter circuit so that the amount of refrigerant to be discharged from the compressor 105 per unit time is allowed to be changed.

The four-way valve 106 is a valve that changes the flow of the refrigerant between, for example, a flow for a cooling operation and a flow for a heating operation.

The outdoor heat exchanger 107 exchanges heat between the refrigerant and outdoor air. In the cooling operation, the outdoor heat exchanger 107 is used as a condenser and condenses the refrigerant into liquid. In the heating operation, the outdoor heat exchanger 107 is used as an evaporator and evaporates the refrigerant into gas.

The expansion valve 108 is a flow control valve and decompresses the refrigerant to expand the refrigerant. When the expansion valve 108 is a device such as an electronic expansion valve, the opening degree of the expansion valve 108 is adjustable in accordance with an instruction issued by a device such as a controller, which is not illustrated.

The indoor unit 102 includes an indoor heat exchanger 109. The indoor heat exchanger 109 exchanges heat between, for example, air to be conditioned and the refrigerant. In the cooling operation, the indoor heat exchanger 109 is used as an evaporator and evaporates the refrigerant into gas. In the heating operation, the indoor heat exchanger 109 is used as a condenser and condenses the refrigerant into liquid.

The air-conditioning apparatus 100 is thus configured to perform the cooling operation and the heating operation by changing the flow of the refrigerant at the four-way valve 106 included in the outdoor unit 101.

<Configuration of Outdoor Unit 101 for Air-Conditioning Apparatus 100>

<Housing of Outdoor Unit 101>

Figure 2:
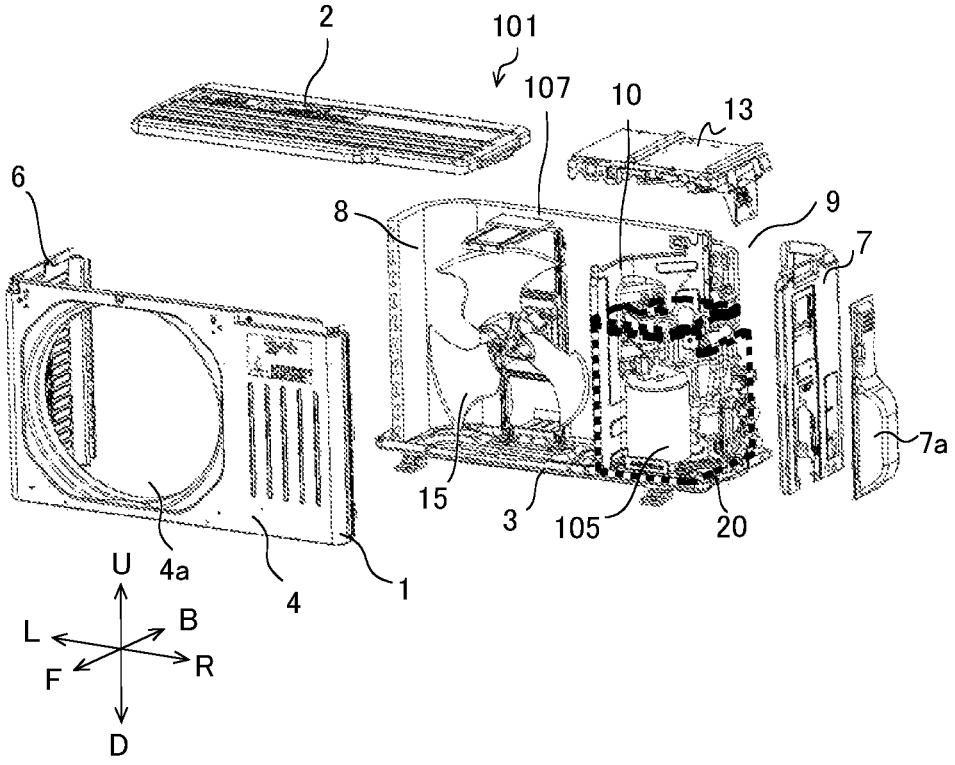
FIG. 2 is an exploded perspective view of an outdoor unit for the air-conditioning apparatus according to Embodiment 1 of the present disclosure, with only a soundproof structure being illustrated by broken lines.

FIG. 2 is an exploded perspective view of the outdoor unit 101 for the air-conditioning apparatus 100 according to Embodiment 1 of the present disclosure, with only a soundproof structure 20 being illustrated by broken lines.

Figure 3:
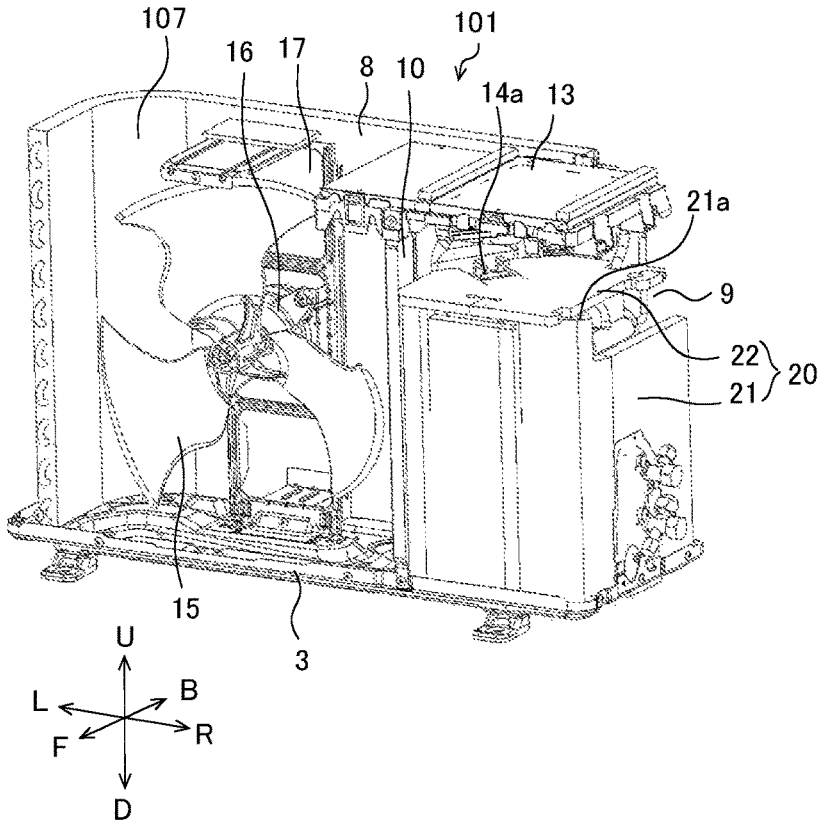
FIG. 3 is a perspective view of the inside of the outdoor unit for the air-conditioning apparatus according to Embodiment 1 of the present disclosure.

As illustrated in FIGS. 2 and 3, the outdoor unit 101 includes a cuboid housing 1 that houses various components. The housing 1 of the outdoor unit 101 includes a top panel 2 at the top of the housing 1 in front view. The housing 1 includes a base 3 at the bottom of the housing 1. The housing 1 includes a front panel 4 at the front of the housing 1. The front panel 4 has a circular opening 4*a* through which air is suctioned toward an air-sending fan 15. The opening 4*a* is provided on the outside front of the front panel 4 with a fan guard shaped in the form of a grating and is not illustrated. The housing 1 includes a left side panel 6 adjoining and bent from the front panel 4 on a left side L in front view. The housing 1 includes a right side panel 7 on a right side R in front view. The right side panel 7 is provided with an adjustment cover 7*a*.

<Internal Configuration of Outdoor Unit 101>

Figure 4:
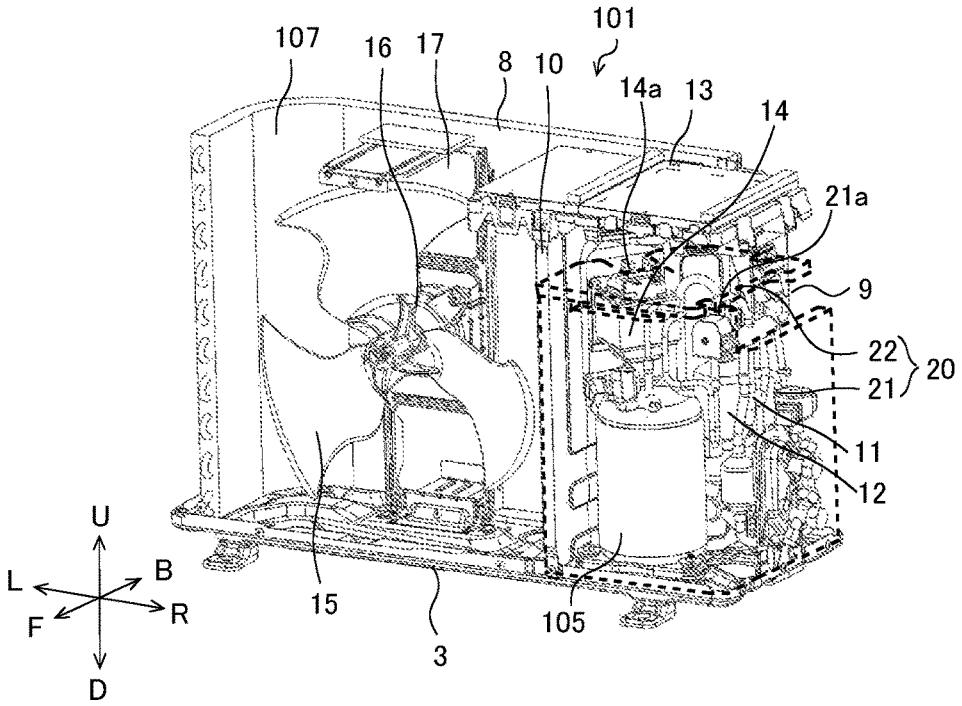
FIG. 4 is a perspective view of the inside of the outdoor unit for the air-conditioning apparatus according to Embodiment 1 of the present disclosure, with only the soundproof structure being illustrated by broken lines.

FIG. 3 is a perspective view of the inside of the outdoor unit 101 for the air-conditioning apparatus 100 according to Embodiment 1 of the present disclosure. FIG. 4 is a perspective view of the inside of the outdoor unit 101 for the air-conditioning apparatus 100 according to Embodiment 1 of the present disclosure, with only the soundproof structure 20 being illustrated by broken lines.

As illustrated in FIGS. 2, 3, and 4, the outdoor unit 101 has a heat exchanger chamber 8 on the left side L in front view. The outdoor unit 101 has a machine chamber 9 on the right side R in front view. The outdoor unit 101 includes inside the outdoor unit 101 a partition 10 that separates the machine chamber 9 and the heat exchanger chamber 8 from each other. The partition 10 separates the inside of the outdoor unit 101 by extending from a front side F to a back side B.

As illustrated in FIG. 4, the compressor 105, a pipe 11, a suction muffler 12, an electrical substrate 13, a reactor 14, and other components are provided in the machine chamber 9.

The compressor 105 is placed on the base 3 at the bottom of the machine chamber 9. The refrigerant that flows into the machine chamber 9 through the gas refrigerant pipe 103 or the liquid refrigerant pipe 104 flows through the suction muffler 12 and the pipe 11 into the compressor 105. The refrigerant is compressed by the compressor 105, flows through a discharge port of the pipe 11, and is sent to either the outdoor heat exchanger 107 or the indoor heat exchanger 109.

The electrical substrate 13 performs operations such as power supply to relevant components. The reactor 14 is fixed to the partition 10. The reactor 14 is positioned higher than the compressor 105. The reactor 14 rectifies an electric current to be supplied to the compressor 105. The reactor 14 has connecting terminals 14*a* projecting from the upper surface of the reactor 14 and to which wires extracted from the electrical substrate 13 are connected. The position of the reactor 14 only needs to be higher than or equal to the position of the compressor 105.

As illustrated in FIG. 2, the compressor 105, the pipe 11, and the suction muffler 12 are enclosed by the soundproof structure 20. Details of the soundproof structure 20 will be described separately below.

As illustrated in FIGS. 2, 3, and 4, the outdoor heat exchanger 107, the air-sending fan 15, a fan motor 16, a motor support 17, and other components are provided in the heat exchanger chamber 8. The outdoor heat exchanger 107 has an L shape when seen from an upper side U and is positioned on the back side B of the heat exchanger chamber 8, that is, behind the air-sending fan 15. The outdoor heat exchanger 107 is present, in the housing 1, on the back side B and the left side L in front view. The fan motor 16 rotates the air-sending fan 15. The motor support 17 fixes the fan motor 16 to the base 3 and to the outdoor heat exchanger 107.

<Soundproof Structure 20>

As illustrated in FIG. 3, the compressor 105 and part of the reactor 14 on and above the base 3 are enclosed by the soundproof structure 20. The soundproof structure 20 is provided for reducing or blocking out noise such as an operating sound emitted from the compressor 105 and an electromagnetic sound emitted from the reactor 14. The soundproof structure 20 includes a peripheral soundproof material 21 and an upper soundproof material 22. The upper soundproof material 22 is placed on upper end portions 21*a* of the peripheral soundproof material 21 that are at a uniform height, and is not placed on another upper end portion of the peripheral soundproof material 21 that is at a height different from the uniform height and where the reactor 14 is present.

<Peripheral Soundproof Material 21>

Figure 5:
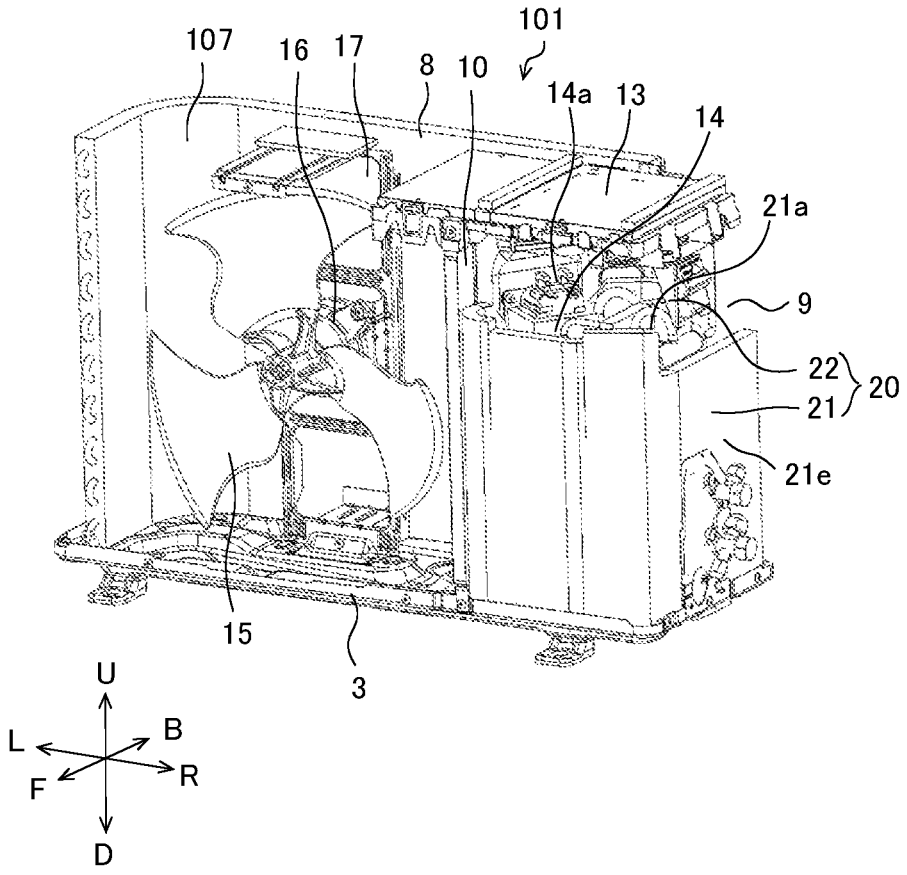
FIG. 5 is a perspective view of the inside, excluding an upper soundproof material, of the outdoor unit for the air-conditioning apparatus according to Embodiment 1 of the present disclosure.
Figure 6:
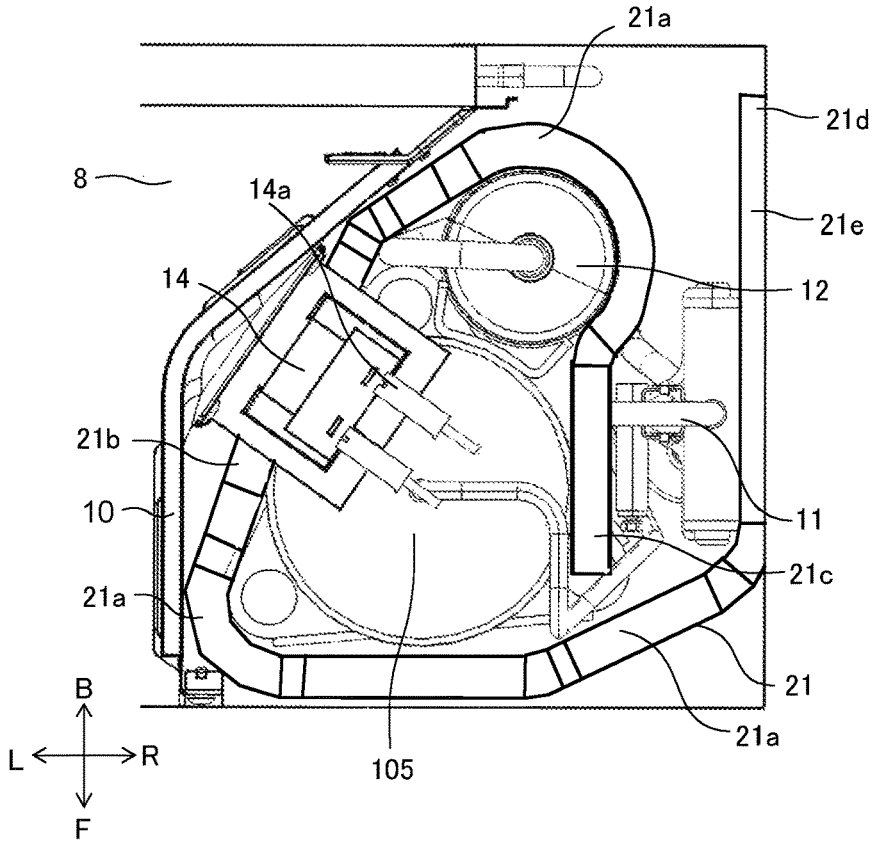
FIG. 6 is a top view of the inside, excluding the upper soundproof material, of a machine chamber provided in the outdoor unit for the air-conditioning apparatus according to Embodiment 1 of the present disclosure.
Figure 7:
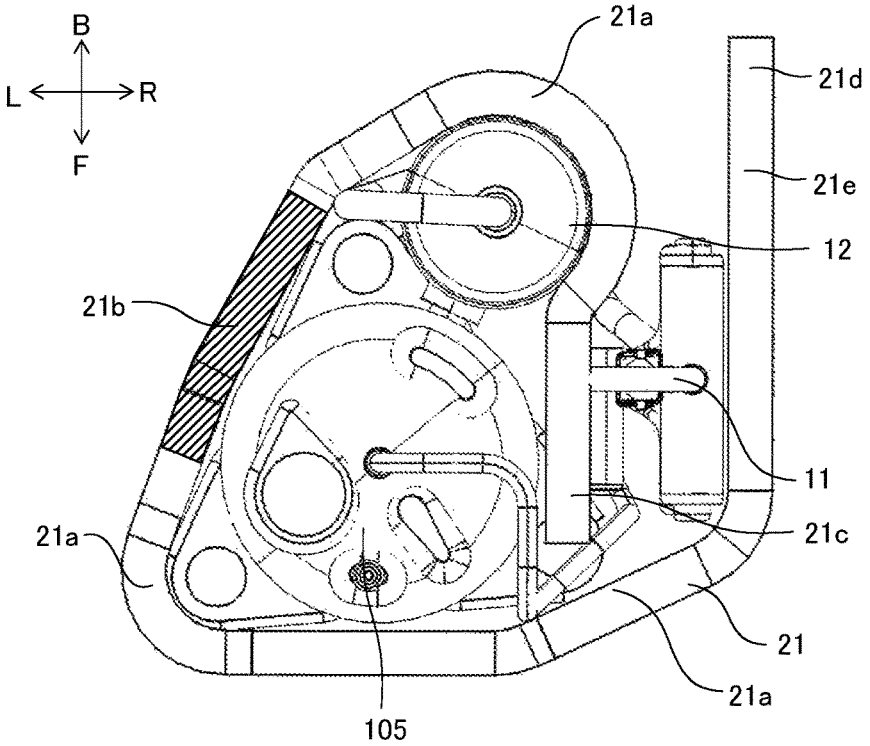
FIG. 7 is a top view of a peripheral soundproof material, enclosing a compressor, according to Embodiment 1 of the present disclosure.

FIG. 5 is a perspective view of the inside, excluding the upper soundproof material 22, of the outdoor unit 101 for the air-conditioning apparatus 100 according to Embodiment 1 of the present disclosure. FIG. 6 is a top view of the inside, excluding the upper soundproof material 22, of the machine chamber 9 provided in the outdoor unit 101 for the air-conditioning apparatus 100 according to Embodiment 1 of the present disclosure. FIG. 7 is a top view of the peripheral soundproof material 21, enclosing the compressor 105, according to Embodiment 1 of the present disclosure.

As illustrated in FIGS. 5, 6, and 7, the peripheral soundproof material 21 extends as high as the position of the reactor 14 and encloses the compressor 105. The peripheral soundproof material 21 has the upper end portions 21*a* that are at the uniform height and the other upper end portion that is at a height different from the uniform height. The other upper end portion is the portion where the reactor 14 is present. As illustrated in FIGS. 6 and 7, three upper end portions 21*a* that are at the uniform height are arranged evenly in good balance at the circumference of the peripheral soundproof material 21, which has a round shape about the compressor 105, such that the upper soundproof material 22 is allowed to be placed on the upper end portions 21*a* without falling from the upper end portions 21*a*. The other upper end portion of the peripheral soundproof material 21 where the reactor 14 is present is an upper end portion 21*b* illustrated in FIG. 6 and hatched in FIG. 7. The upper end portion 21*b* is positioned lower than the other upper end portions 21*a* to extend around the reactor 14.

As illustrated in FIGS. 5, 6, and 7, the peripheral soundproof material 21 is made of a single sheet. The peripheral soundproof material 21 has an overlap 21*e* where an inner lateral end portion 21*c* and an outer lateral end portion 21*d* overlap each other at an area beside, on the right side R of, the compressor 105. The overlap 21*e* is obtained by extending the outer lateral end portion 21*d* toward the back side B beyond the inner lateral end portion 21*c*. As illustrated in FIG. 6, the overlap 21*e* extends along the back of the right side panel 7 and is also fire-resistant to prevent fire from spreading into the outdoor unit 101 through the gas refrigerant pipe 103 and the liquid refrigerant pipe 104 connected to the indoor unit 102.

The peripheral soundproof material 21 does not necessarily need to be made of a single sheet and may be made of a plurality of separate materials that are stacked on or joined to one another, for example. The peripheral soundproof material 21 may have projections and depressions, which increase sound absorbency, on the inner surface of the peripheral soundproof material 21. The material of the peripheral soundproof material 21 may be any of the following, for example: sound-absorbing, sound-reducing, and sound-blocking materials such as a sheet, a board, urethane, sponge, fabric, and glass wool, preferably with heat resistance. The peripheral soundproof material 21 only needs to reach the height where the reactor 14 is positioned.

<Upper Soundproof Material 22>

Figure 8:
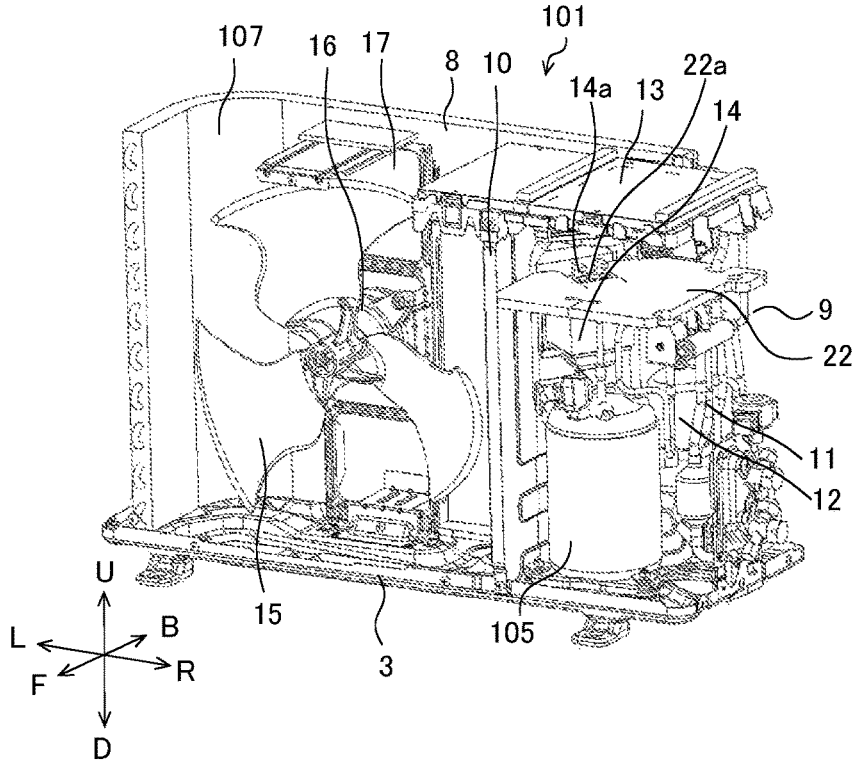
FIG. 8 is a perspective view of the inside, excluding the peripheral soundproof material, of the outdoor unit for the air-conditioning apparatus according to Embodiment 1 of the present disclosure.
Figure 9:
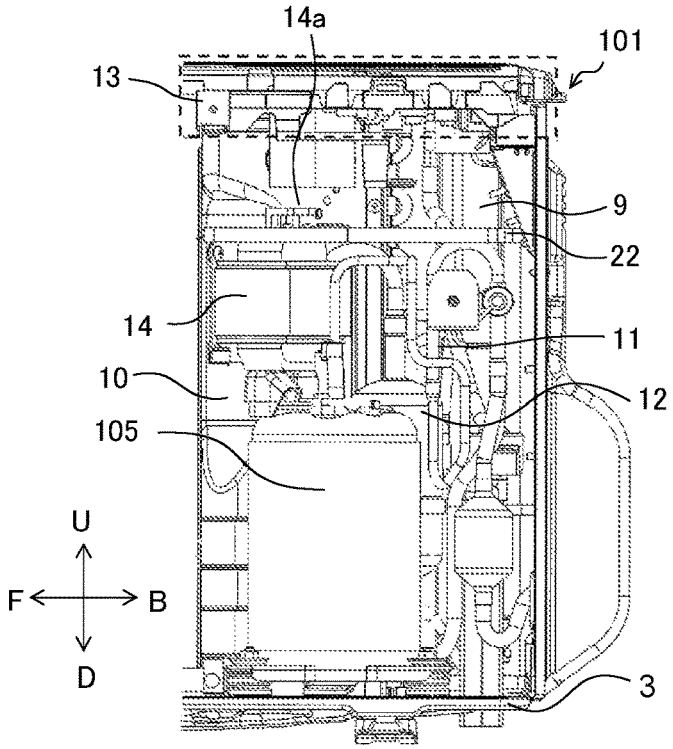
FIG. 9 is a side view of the inside, seen from the right side and excluding the peripheral soundproof material, of the machine chamber provided in the outdoor unit for the air-conditioning apparatus according to Embodiment 1 of the present disclosure.

FIG. 8 is a perspective view of the inside, excluding the peripheral soundproof material 21, of the outdoor unit 101 for the air-conditioning apparatus 100 according to Embodiment 1 of the present disclosure. FIG. 9 is a side view of the inside, seen from the right side R and excluding the peripheral soundproof material 21, of the machine chamber 9 provided in the outdoor unit 101 for the air-conditioning apparatus 100 according to Embodiment 1 of the present disclosure.

As illustrated in FIGS. 8 and 9, the upper soundproof material 22 covers at least part of the reactor 14 and is placed on the upper end portions 21*a* of the peripheral soundproof material 21 that are at the uniform height, and is not placed on the other upper end portion of the peripheral soundproof material 21 that is at a height different from the uniform height and where the reactor 14 is present.

The upper soundproof material 22 has a cut 22*a* outlined around the connecting terminals 14*a* projecting from the upper surface of the reactor 14. The upper soundproof material 22 is placed such that the cut 22*a* is fitted around the connecting terminals 14*a* and the upper soundproof material 22 covers part of the upper surface of the reactor 14 and does not cover the connecting terminals 14*a* projecting from the upper surface of the reactor 14.

The upper soundproof material 22 only needs to cover at least part of the upper surface of the reactor 14. Alternatively, the upper soundproof material 22 only needs to cover at least part, such as the peripheral face, of the reactor 14.

The upper soundproof material 22 is made of a single sheet. At least a topmost layer of the upper soundproof material 22 is made of a rubber material. The upper soundproof material 22 is made of a material that is denser than the peripheral soundproof material 21.

The upper soundproof material 22 does not necessarily need to be made of a single sheet and may be made of a plurality of separate materials that are stacked on or joined to one another, for example. The upper soundproof material 22 may include a thick material used as a portion by which the reactor 14 is enclosed, with the other portion made of thin materials, for example. Furthermore, the upper soundproof material 22 may have a number of chips sprinkled on and pasted to the upper soundproof material 22 with pieces of tape or sheets. The upper soundproof material 22 may have projections and depressions, which increase sound absorbency, on the inner surface of the upper soundproof material 22. The material of the upper soundproof material 22 may be any of the following, for example: sound-absorbing, sound-reducing, and sound-blocking materials such as a sheet, a board, urethane, sponge, fabric, and glass wool, preferably with heat resistance. Regarding the material of the upper soundproof material 22, at least one of layers of the upper soundproof material 22 is preferably waterproof over the entirety face of the upper soundproof material 22 to prevent the entry of dew water. The upper soundproof material 22 may be integrated with the peripheral soundproof material 21 to form, for example, a sheet in which the upper soundproof material 22 and the peripheral soundproof material 21 are continuous with each other.

<Partition 10 to which Reactor 14 is Fixed>

Figure 10:
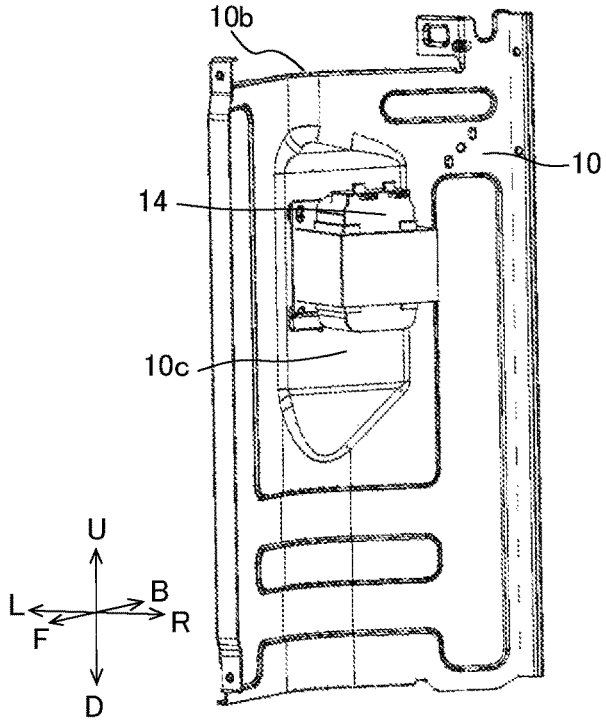
FIG. 10 is a perspective view of a reactor fixed to a partition according to Embodiment 1 of the present disclosure.
Figure 11:
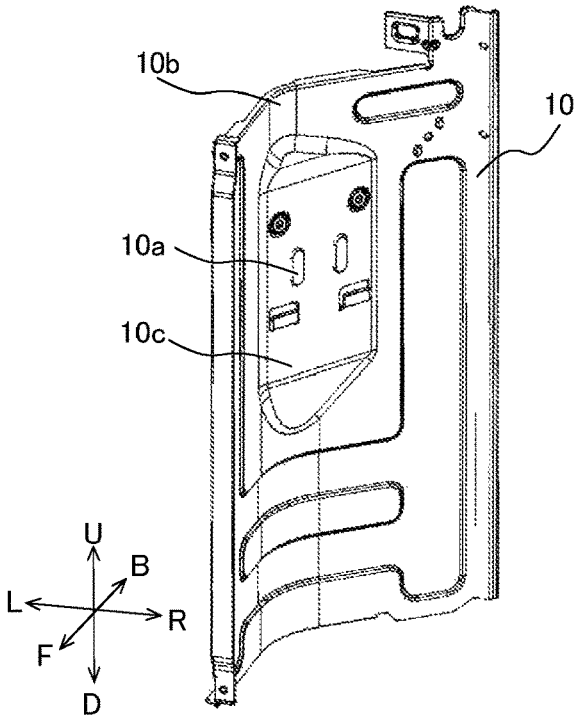
FIG. 11 is a perspective view of the partition according to Embodiment 1 of the present disclosure, seen from the machine chamber.
Figure 12:
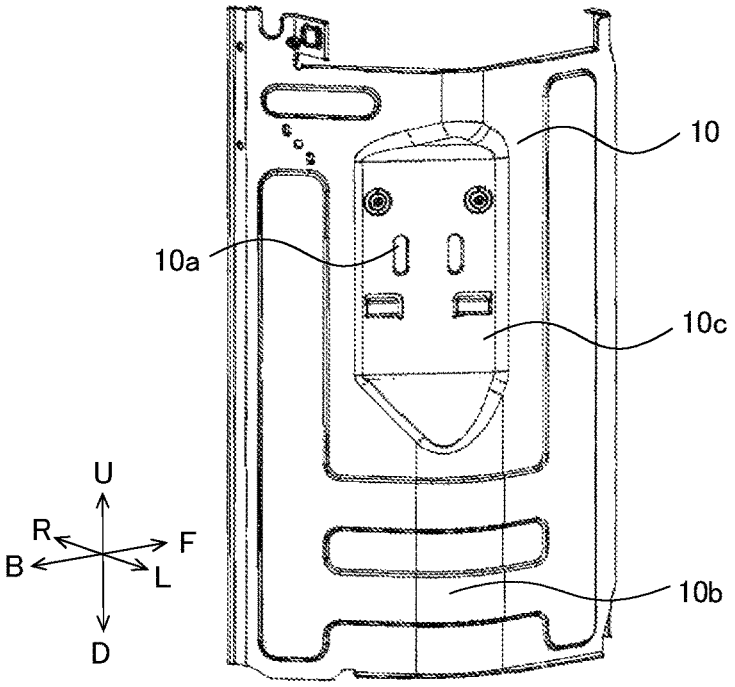
FIG. 12 is a perspective view of the partition according to Embodiment 1 of the present disclosure, seen from a heat exchanger chamber.
Figure 13:
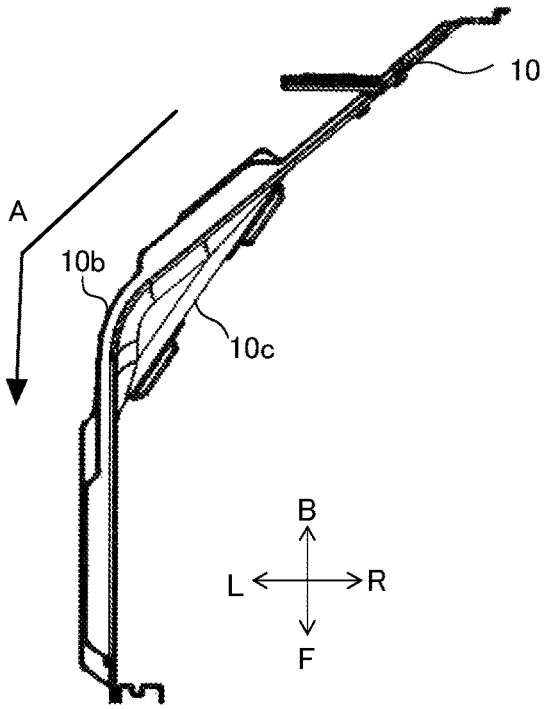
FIG. 13 is a top view of the partition according to Embodiment 1 of the present disclosure.

FIG. 10 is a perspective view of the reactor 14 fixed to the partition 10 according to Embodiment 1 of the present disclosure. FIG. 11 is a perspective view of the partition 10 according to Embodiment 1 of the present disclosure, seen from the machine chamber 9. FIG. 12 is a perspective view of the partition 10 according to Embodiment 1 of the present disclosure, seen from the heat exchanger chamber 8. FIG. 13 is a top view of the partition 10 according to Embodiment 1 of the present disclosure.

As illustrated in FIG. 10, the reactor 14 is fixed to a face of the partition 10 that faces the machine chamber 9. The reactor 14 is provided on the upper side U of the compressor 105 and at a halfway position of the partition 10 in the vertical direction.

As illustrated in FIGS. 11, 12, and 13, the partition 10 has a cooling mechanism in a back face of the partition 10 in a region in which the reactor 14 is fixed. The cooling mechanism includes cooling holes 10*a* provided in the back face of the partition 10 at the region in which the reactor 14 is fixed. The cooling holes 10*a* each extend through the partition 10. The partition 10 extends in a direction of airflow A illustrated in FIG. 13 and is bent around the region in which the reactor 14 is fixed such that a face of the partition 10 toward the machine chamber 9 projects toward the heat exchanger chamber 8 and only the region in which the reactor 14 is fixed is flat. A bent portion 10*b*, which is a portion that is bent around the region in which the reactor 14 is fixed such that the face of the partition 10 toward the machine chamber 9 projects toward the heat exchanger chamber 8, makes it easy to blow the air from the heat exchanger chamber 8 to the back of the reactor 14. In a flat portion 10*c*, which is the region in which the reactor 14 is fixed, the back of the reactor 14 is completely in contact with the partition 10 to receive the air from the heat exchanger chamber 8 through the cooling holes 10*a*, and cooling performance is thus improved.

The cooling mechanism may be configured in another manner. The cooling mechanism may be a device such as a heat sink provided on a face of the partition 10 that faces the heat exchanger chamber 8.

<Attaching Peripheral Soundproof Material 21 and Upper Soundproof Material 22>

First, the peripheral soundproof material 21 is placed such that the peripheral soundproof material 21 encloses the compressor 105. Subsequently, the upper soundproof material 22 is placed over the compressor 105, which is enclosed by the peripheral soundproof material 21, and part of the reactor 14.

<Modification 1>

Figure 14:
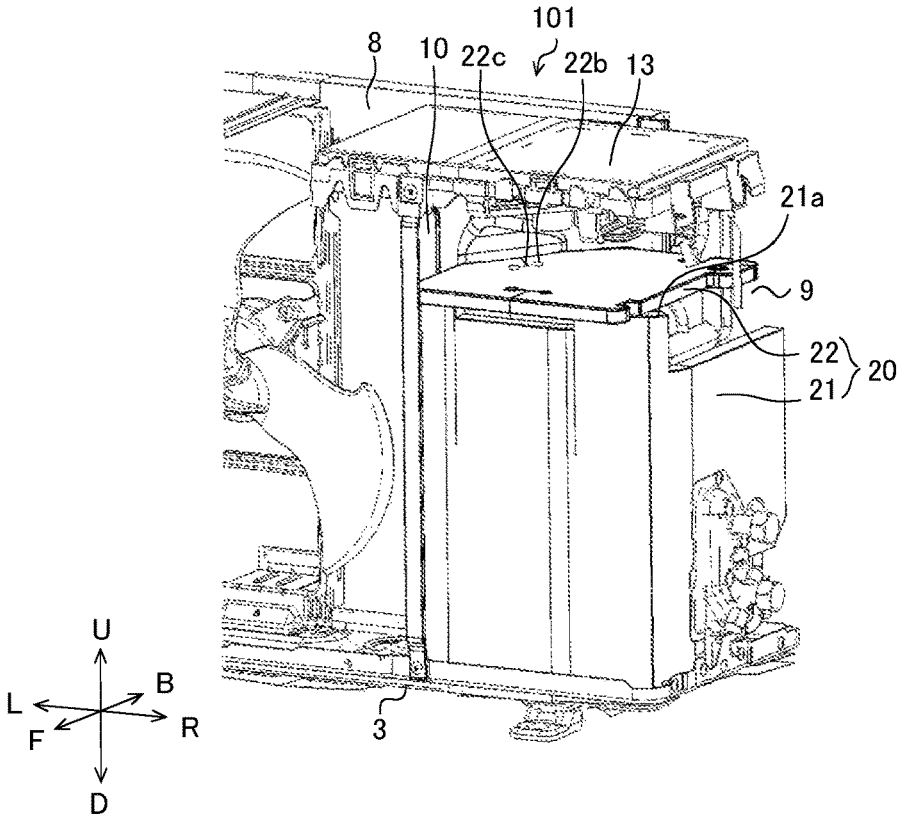
FIG. 14 is a perspective view of the inside of a machine chamber provided in an outdoor unit for an air-conditioning apparatus according to Modification 1 of Embodiment 1 of the present disclosure.
Figure 15:
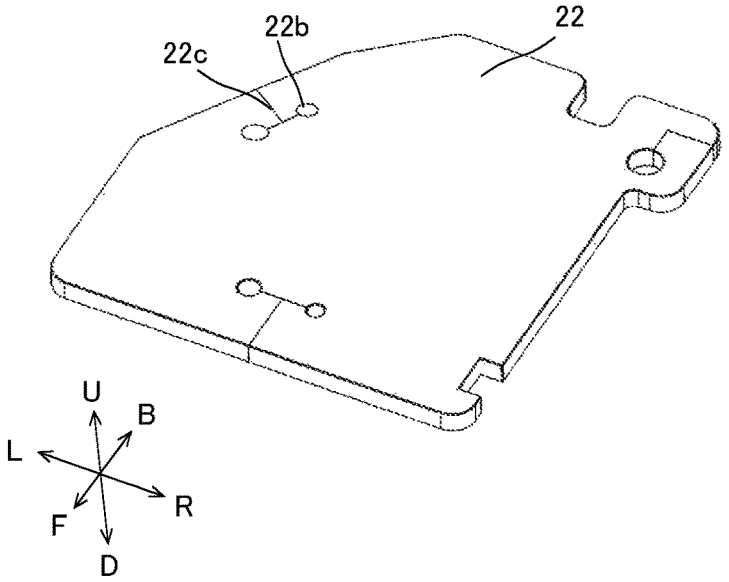
FIG. 15 is a perspective view of an upper soundproof material according to Modification 1 of Embodiment 1 of the present disclosure.

FIG. 14 is a perspective view of the inside of a machine chamber 9 provided in an outdoor unit 101 for an air-conditioning apparatus 100 according to Modification 1 of Embodiment 1 of the present disclosure. FIG. 15 is a perspective view of an upper soundproof material 22 according to Modification 1 of Embodiment 1 of the present disclosure.

As illustrated in FIGS. 14 and 15, the upper soundproof material 22 covers the entirety of the upper surface of the reactor 14. The upper soundproof material 22 has through holes 22*b* that allow wires connected to the connecting terminals 14*a* of the reactor 14 to pass through the upper soundproof material 22 toward the upper side U. The through holes 22*b* are continuous with a slit 22*c* extending from the circumference of the upper soundproof material 22. The upper soundproof material 22 has another set of through holes and a slit provided on the front side F of the upper soundproof material 22 and through which wires connected to the compressor 105 are to be extracted.

The tips of the connecting terminals 14*a* of the reactor 14 may be bent toward the upper side U and made to project from the through holes 22*b*.

<Modification 2>

Figure 16:
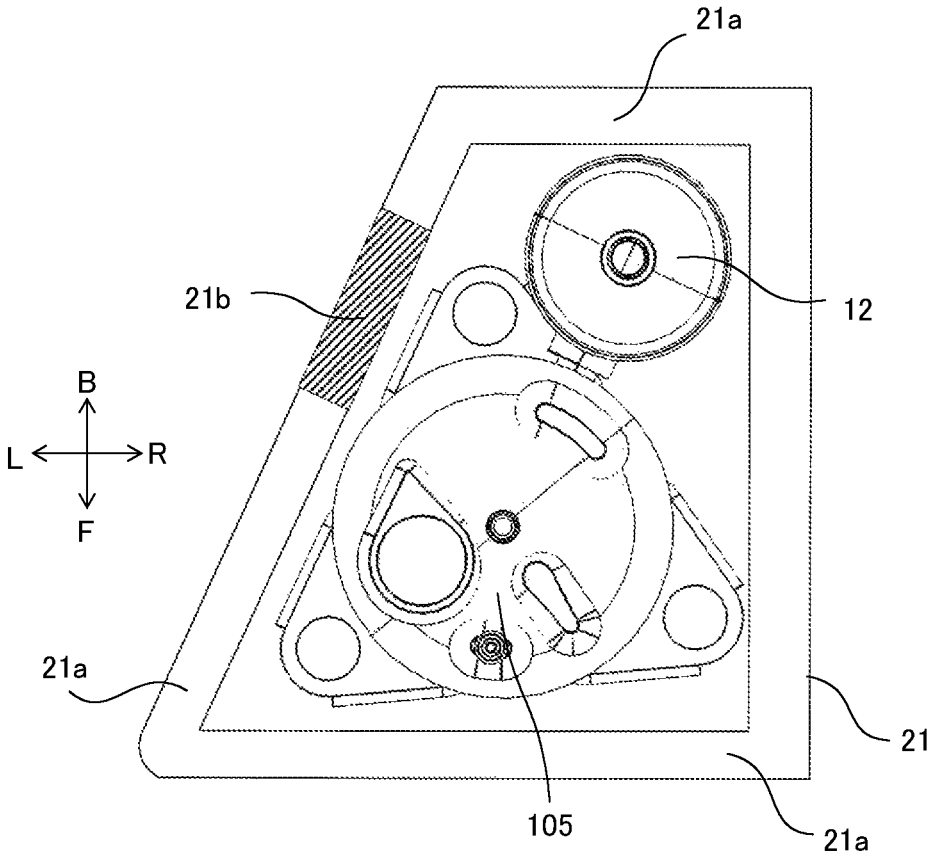
FIG. 16 is a top view of a peripheral soundproof material, enclosing a compressor, according to Modification 2 of Embodiment 1 of the present disclosure.

FIG. 16 is a top view of a peripheral soundproof material 21, enclosing the compressor 105, according to Modification 2 of Embodiment 1 of the present disclosure. As illustrated in FIG. 16, the peripheral soundproof material 21 may have an endless cylindrical shape with neither the overlap 21*e* nor the lateral end portions. The cylindrical peripheral soundproof material 21 has upper end portions 21*a* that are at a uniform height, and an upper end portion 21*b*, hatched in the drawing, that is at a height different from the uniform height and where the reactor 14 is present.

<Advantageous Effects of Embodiment 1>

According to Embodiment 1, the outdoor unit 101 for the air-conditioning apparatus 100 includes the machine chamber 9. The outdoor unit 101 for the air-conditioning apparatus 100 includes the compressor 105 provided in and at the bottom of the machine chamber 9. The outdoor unit 101 for the air-conditioning apparatus 100 includes the reactor 14 provided in the machine chamber 9 and higher than or equal to the compressor 105 and configured to rectify an electric current to be supplied to the compressor 105. The outdoor unit 101 for the air-conditioning apparatus 100 includes the peripheral soundproof material 21 that extends as high as the position of the reactor 14 and encloses the compressor 105. The outdoor unit 101 for the air-conditioning apparatus 100 includes the upper soundproof material 22 that covers at least part of the reactor 14 and is placed on the peripheral soundproof material 21.

In such a case, the peripheral soundproof material 21 extends as high as the position of the reactor 14 and encloses the compressor 105. Furthermore, the upper soundproof material 22 covers at least part of the reactor 14 and is placed on the peripheral soundproof material 21. That is, at least part of the reactor 14 and the compressor 105 are enclosed by the peripheral soundproof material 21 and the upper soundproof material 22. Therefore, the electromagnetic sound emitted from the reactor 14 and the operating sound emitted from the compressor 105 are both reduced. Furthermore, as there is no need to enclose the space below the electrical substrate 13 by a box made of sheet metal, that is, as no box is provided, the machine chamber 9 is not limited to be narrow. Moreover, as no box made of sheet metal is used, a cost reduction is achieved. Thus, the electromagnetic sound of the reactor 14 and the operating sound of the compressor 105 are both reduced, the space in the machine chamber 9 is not limited to be narrow, and a cost reduction is achieved.

According to Embodiment 1, the upper soundproof material 22 covers at least part of the upper surface of the reactor 14.

In such a case, at least part of the upper surface of the reactor 14 and the compressor 105 are enclosed by the peripheral soundproof material 21 and the upper soundproof material 22. Therefore, the electromagnetic sound emitted from the reactor 14 and the operating sound emitted from the compressor 105 are both reduced further. In addition, the heat radiated from the reactor 14 toward the electrical substrate 13 provided above the reactor 14 is reduced by the upper soundproof material 22.

According to Embodiment 1, the connecting terminals 14*a* to which the wires extracted from the electrical substrate 13 are connected project from the upper surface of the reactor 14. The upper soundproof material 22 has the cut 22*a* outlined around the connecting terminals 14*a*. The upper soundproof material 22 is placed such that the cut 22*a* is fitted around the connecting terminals 14*a* and the upper soundproof material 22 covers part of the upper surface of the reactor 14 and does not cover the connecting terminals 14*a* projecting from the upper surface of the reactor 14.

In such a case, the upper soundproof material 22 covers the portion of the upper surface of the reactor 14 and does not cover the connecting terminals 14*a*. Therefore, the electromagnetic sound emitted from the reactor 14 and the operating sound emitted from the compressor 105 are both reduced much further. In addition, the heat radiated from the reactor 14 toward the electrical substrate 13 provided above the reactor 14 is reduced further by the upper soundproof material 22.

According to Embodiment 1, the upper soundproof material 22 covers the entirety of the upper surface of the reactor 14.

In such a case, the upper soundproof material 22 covers the entirety of the upper surface of the reactor 14. Therefore, the electromagnetic sound emitted from the reactor 14 and the operating sound emitted from the compressor 105 are both blocked out. In addition, the heat radiated from the reactor 14 toward the electrical substrate 13 provided above the reactor 14 is blocked out by the upper soundproof material 22.

According to Embodiment 1, the peripheral soundproof material 21 has the upper end portions 21*a* that are at a uniform height and the other upper end portion that is at a height different from the uniform height. The other upper end portion is the portion where the reactor 14 is present. The upper soundproof material 22 is placed on the upper end portions 21*a* of the peripheral soundproof material 21 that are at the uniform height, and is not placed on the other upper end portion of the peripheral soundproof material 21 that is at a height different from the uniform height and where the reactor 14 is present.

In such a case, the upper soundproof material 22 is allowed to be placed stably on the peripheral soundproof material 21. Thus, the sound-blocking performance exerted by the peripheral soundproof material 21 and the upper soundproof material 22 is improved. Therefore, the electromagnetic sound emitted from the reactor 14 and the operating sound emitted from the compressor 105 are both reduced.

According to Embodiment 1, the outdoor unit 101 for the air-conditioning apparatus 100 includes the partition 10 that separates the inside of the outdoor unit 101 into the machine chamber 9 and the heat exchanger chamber 8. The reactor 14 is fixed to the partition 10.

In such a case, a process of setting the reactor 14 and laying wires related to the setting of the reactor 14 is done before the housing 1 of the outdoor unit 101 is covered, making the manufacturing of the outdoor unit 101 easy.

According to Embodiment 1, the partition 10 has the cooling holes 10*a*, used as the cooling mechanism, in the back face at the region in which the reactor 14 is fixed.

In such a case, the reactor 14 is cooled from the back through the cooling holes 10*a*. Therefore, even when the reactor 14 generates heat in the space enclosed by the peripheral soundproof material 21 and the upper soundproof material 22, the reactor 14 is cooled, preventing heat accumulation.

According to Embodiment 1, the cooling mechanism includes the cooling holes 10*a* provided in the back face at the region in which the reactor 14 is fixed, the cooling holes 10*a* each extending through the partition 10.

In such a case, the reactor 14 is cooled from the back through the cooling holes 10*a* provided in the partition 10. Therefore, even when the reactor 14 generates heat in the space enclosed by the peripheral soundproof material 21 and the upper soundproof material 22, the reactor 14 is cooled with a simple configuration, preventing heat accumulation.

According to Embodiment 1, the partition 10 extends in the direction of airflow A and is bent at the bent portion 10*b*, around the region in which the reactor 14 is fixed, such that the face of the partition 10 toward the machine chamber 9 projects and only the region in which the reactor 14 is fixed is flat as the flat portion 10*c*.

In such a case, the air flowing in the direction of airflow A for heat exchange in the outdoor unit 101 is easily blown to part of the reactor 14 at in the region in which the reactor 14 is fixed, that is, the bent portion 10*b* where the partition 10 is bent. Therefore, the reactor 14 is cooled efficiently by the air flowing in the outdoor unit 101. Furthermore, as the partition 10 includes the flat portion 10*c* only in the region in which the reactor 14 is fixed, the reactor 14 is allowed to be easily fixed to the partition 10.

According to Embodiment 1, the peripheral soundproof material 21 is made of a single sheet.

In such a case, the peripheral soundproof material 21 is made simple.

According to Embodiment 1, the peripheral soundproof material 21 includes the overlap 21*e* where the inner lateral end portion 21*c* and the outer lateral end portion 21*d* overlap each other at an area beside the compressor 105.

In such a case, as the inner lateral end portion 21*c* and the outer lateral end portion 21*d* of the peripheral soundproof material 21 overlap each other, the sound-blocking performance is improved.

According to Embodiment 1, the upper soundproof material 22 is made of a single sheet.

In such a case, the upper soundproof material 22 is made simple.

According to Embodiment 1, the upper soundproof material 22 includes at least one layer made of a rubber material.

In such a case, dew water forming in the machine chamber 9 is prevented from running down through the upper soundproof material 22. Therefore, the durability of mechanical components provided in the space enclosed by the peripheral soundproof material 21 and the upper soundproof material 22 is increased.

According to Embodiment 1, the upper soundproof material 22 is made of a material that is denser than the peripheral soundproof material 21.

In such a case, the sound-blocking performance and waterproof performance of the upper soundproof material 22 is improved.

According to Embodiment 1, the air-conditioning apparatus 100 includes the outdoor unit 101 for air-conditioning apparatus 100.

In such a case, in the air-conditioning apparatus 100 including the outdoor unit 101 for the air-conditioning apparatus 100, the electromagnetic sound of the reactor 14 and the operating sound of the compressor 105 are both reduced, the space in the machine chamber 9 is not limited to be narrow, and a cost reduction is achieved.

The invention claimed is:

1. An outdoor unit for an air-conditioning apparatus, the outdoor unit comprising:

a machine chamber;

a compressor provided in and at a bottom of the machine chamber;

a reactor provided in the machine chamber and higher than the compressor and configured to rectify an electric current to be supplied to the compressor;

a peripheral soundproof material that extends as high as a position of the reactor and encloses the compressor; and an upper soundproof material that covers the compressor and is placed on the peripheral soundproof material, a connecting terminal projecting from and disposed on an upper surface of the reactor, to a wire extracted from an electrical substrate connecting to the connecting terminal, the upper soundproof material having a cut outlined around the connecting terminal, the upper soundproof material covering at least part of the upper surface of the reactor, and the peripheral soundproof material and the upper soundproof material each being one of a sheet, a board, urethane, sponge, fabric, and glass wool that reduces or blocks an operating sound emitted from the compressor or an electromagnetic sound emitted from the reactor, wherein the peripheral soundproof material has upper end portions that are at a uniform height and an other upper end portion that is at a height different from the uniform height, the other upper end portion being a portion where the reactor is present, and wherein the upper soundproof material is placed on the upper end portions of the peripheral soundproof material that are at the uniform height, and is not placed on the other upper end portion of the peripheral soundproof material that is at a height different from the uniform height and where the reactor is present.

2. The outdoor unit for the air-conditioning apparatus of claim 1, wherein the upper soundproof material is placed such that the cut is fitted around the connecting terminal and the upper soundproof material covers part of the upper surface of the reactor and does not cover the connecting terminal projecting from the upper surface of the reactor.

3. The outdoor unit for the air-conditioning apparatus of claim 1, the outdoor unit further comprising a partition that separates an inside of the outdoor unit into the machine chamber and a heat exchanger chamber, wherein the reactor is fixed to the partition.

4. The outdoor unit for the air-conditioning apparatus of claim 3, wherein the partition has a cooling mechanism in a back face at a region in which the reactor is fixed.

5. The outdoor unit for the air-conditioning apparatus of claim 1, wherein the upper soundproof material is made of a material that is denser than the peripheral soundproof material.

6. An air-conditioning apparatus comprising the outdoor unit of claim 1.

* * * * *